US005145392A

United States Patent [19]

Kemp

[11] Patent Number: 5,145,392

[45] Date of Patent: Sep. 8, 1992

[54] SELF-LOCKING BIPIN LAMP HOLDER

[75] Inventor: Richard R. Kemp, Urbana, Ohio

[73] Assignee: F. L. Aerospace Corp., Urbana, Ohio

[21] Appl. No.: 755,285

[22] Filed: Sep. 5, 1991

[51] Int. Cl.[5] ..... H01R 33/02

[52] U.S. Cl. ..... 439/232; 439/372

[58] Field of Search ..... 439/240–244, 439/232, 233, 237, 611, 612, 617, 372

[56] References Cited

U.S. PATENT DOCUMENTS 2,569,662 10/1951 Fallek ..... 439/372
3,851,295 11/1974 Geier ..... 439/232

FOREIGN PATENT DOCUMENTS 1028686 4/1958 Fed. Rep. of Germany ..... 439/232
1117754 11/1961 Fed. Rep. of Germany ..... 439/232

*Primary Examiner*—Neil Abrams
*Assistant Examiner*—Hien D. Vu
*Attorney, Agent, or Firm*—John D. Kaufmann

[57] ABSTRACT

A holder for one end of a bi-pin fluorescent lamp has slots for slidably receiving the pins. The pins abut and then move electrical contacts against spring bias thereon as the received pins move in the slots. After sufficient movement of the pins and contacts, a slide is moved by a spring to block reverse movement of the pins and contacts. Rotation of a lever on the holder reversely moves the slide to permit the contacts to eject the pins from the slots.

15 Claims, 4 Drawing Sheets

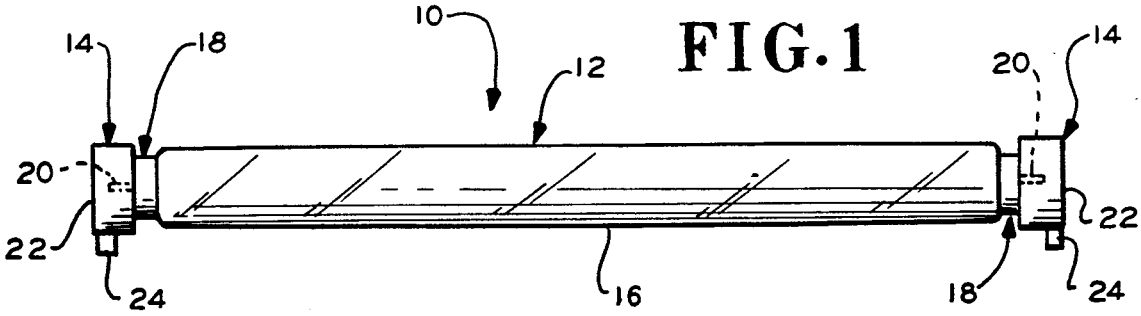
FIG. 1
FIG. 4
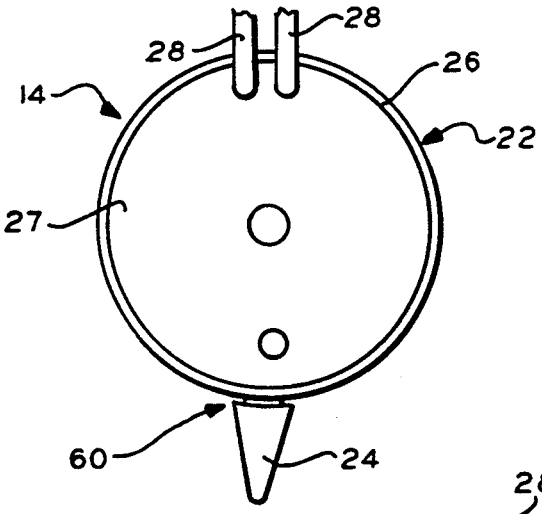
FIG. 3
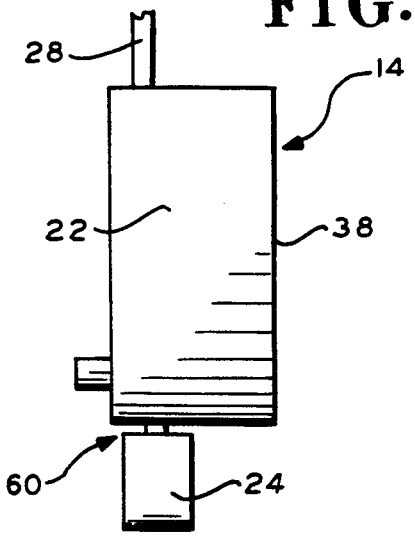
FIG. 2
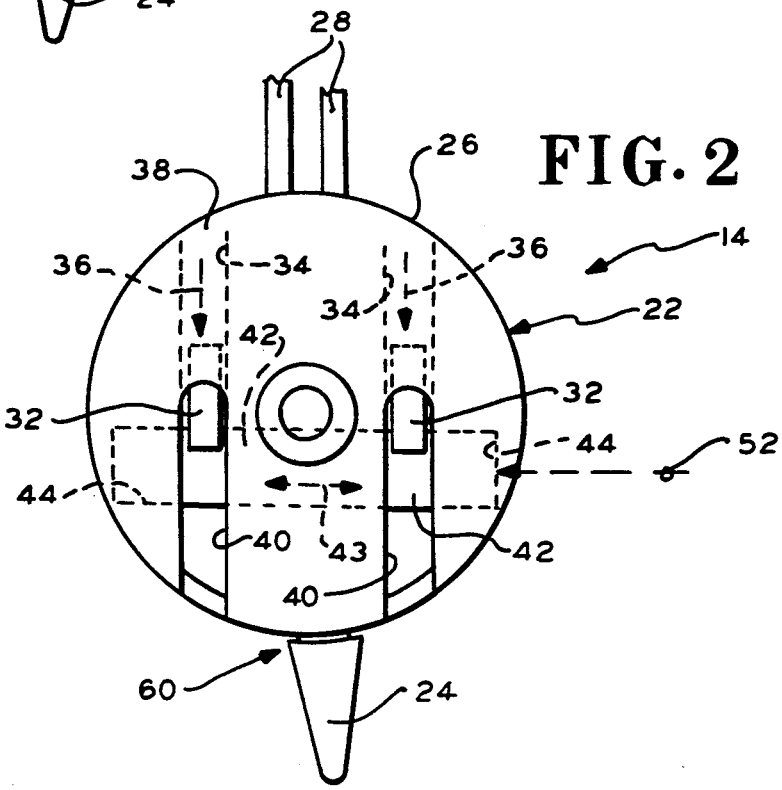

FIG. 13
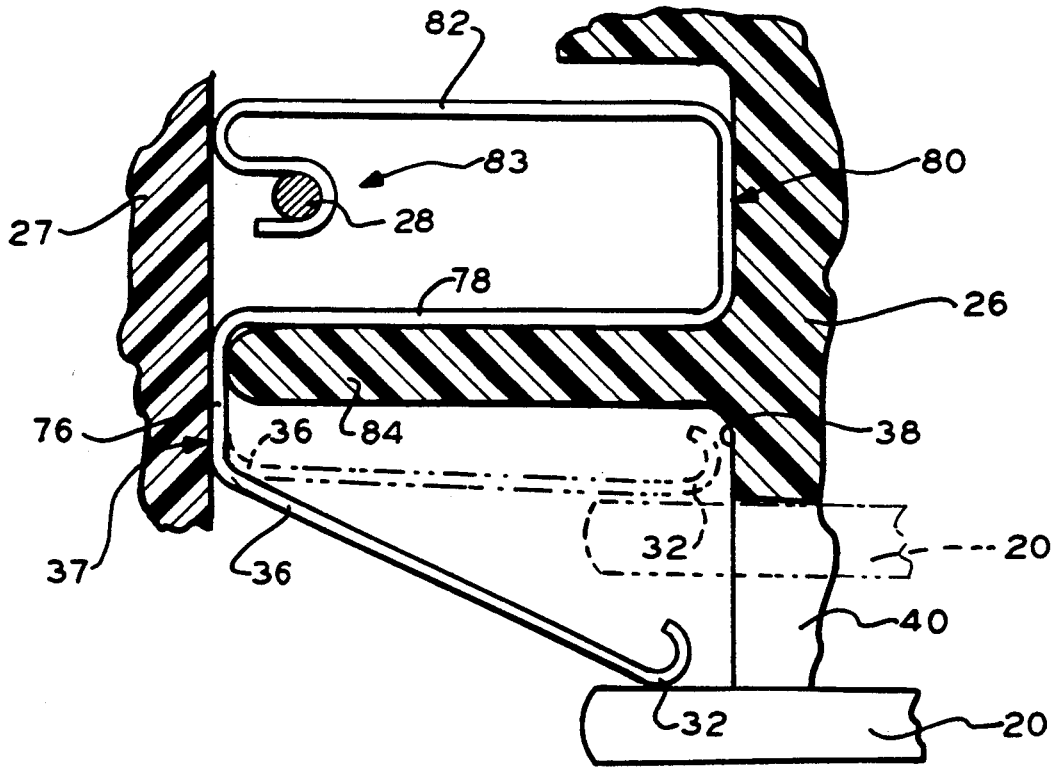
FIG. 14
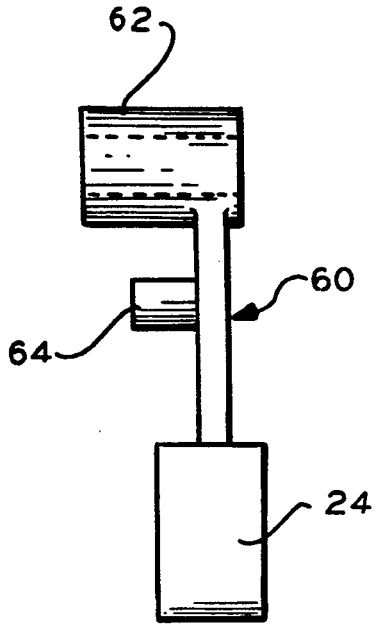
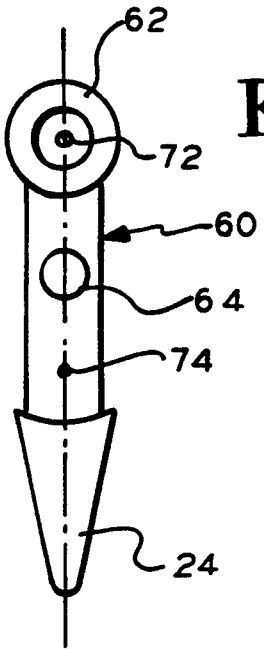
FIG. 15

SELF-LOCKING BIPIN LAMP HOLDER

BACKGROUND OF THE INVENTION

The present invention relates to a self-locking holder for a lamp of the type having external pin contacts, and more particularly to such a lamp holder for bipin fluorescent lamps.

A simple, easy to use and reliable holder for bipin lamps, such as fluorescent lamps, has long been a sought-after goal. Most of the prior holders have been complicated, and at times expensive, and have not possessed reliable self-locking features. Lack of reliable self-locking is especially troublesome on aircraft and in other transportation media, since minimizing the labor costs of lamping is important and since shock and vibration attendant to operation may cause the holder to release the lamp, leading to its breakage. Moreover, vibration and shock may lead to intermittent or flickering lamp operation if self-locking is not sufficiently positive.

Other problems with prior art lamp holders are discussed in U.S. Pat. No. 3,851,295, which discloses a lamp holder of the type generally involved herein.

A major objective of the present invention is to improve on prior art lamp holders, including that of the '295 Patent, by providing an inexpensive, simple bipin lamp holder which is reliably self-locking, easy to relamp, and which manifests all of the positive attributes generally desired in such a lamp holder.

SUMMARY OF THE INVENTION

With the above and other objectives in mind, the present invention contemplates a self-locking holder for a bipin lamp. The holder permits a lamp to be inserted and held without manipulation of any item except for the lamp. Once inserted, the lamp is positively held and maintained in positive electrical engagement with contacts so as to minimize the intermittent or flickering operation. When removal of the lamp is desired, simple digital manipulation effects self-ejection of the lamp. The holder possesses a minimal number of parts and is inexpensive to manufacture.

The holder includes a housing, which is mountable to an appropriate surface, such as the bulkhead or overhand of an aircraft cabin. Where typical two-ended lamps with electrode pins at both ends are used, a light fixture will have two opposed holders to accommodate therebetween a lamp, such as a fluorescent lamp. The housings are intended to overlie the ends of the lamp.

The housing includes blind slots for receiving the lamp pins therein with the pins being perpendicular to the plane of the slots. The pins are movable or slidable in and along the slots in a first direction until they abut the slot ends which serve as stops. Contacts aligned with the slots are provided within the housing, one for each slot. A biasing facility biases the contacts to a first position relative to the slots whereat they are abuttable by the pins. Sufficient movement of the pins in the first direction effects abutment between the pins and the contacts and then moves the contacts and the pins against the biasing facility to a second position. The foregoing action occurs as the lamp is manually inserted.

A movable slide is located within the housing. The slide is held in a first location by the contacts when the contacts are in their first position. Another facility biases the slide toward a second location. The slide includes latches. When the slide is in its first location, the latches are away from the slots and cannot interfere with the movement of the pins therealong. When the contacts and the pins move to the second position, the slide is no longer held and the pins move to the second position, the slide is no longer held and the biasing facility moves the slide to its second location. In the second location of the slide the latches do interfere with the movement of the pins in the slots in a second direction opposite that along which the pins were inserted into the slots. This interference maintains the pins and the contacts in abutment and prevents the pins from moving out of the slots.

A facility is provided for moving the slide against is biasing facility and back to the first location, thereby moving the latches away from the slots. This permits the contact-biasing facility to move the contacts and the pins in the second direction to eject the pins from the slots. Once this occurs, while the slide is again in the first location, first the pins and then the contacts again prevents the slide's movement to the second location. Preferably the slide-moving facility is a rotatable lever pivoted within the housing with a finger-engageable and accessible outside the housing. Appropriate rotation of the lever moves the slide back to its first location against the slide biasing facility.

Preferably, the slide is held in its first location by interference between the contacts and the latches. In this event, the latches may contain camming surfaces. As the pins move the contacts out of interference with the latches, but before the pins clear the latches, the camming surfaces permit uninhibited movement of the pins past the latches. Both of the biasing facilities may constitute convenient resilient members, such leaf or coil springs, acting between the housing and, respectively, the contacts and the slide.

BRIEF DESCRIPTION OF THE DRAWING

FIG. 1 is a front elevation of a light fixture of a type generally known which includes at each end of a bipin fluorescent lamp a lamp holder according to the present invention;

FIGS. 2–5 are, respectively, a front elevation, side elevation and rear elevation of a lamp holder according to the present invention;

FIGS. 5–10 are similar to FIG. 2 and depict various stages of operation of the present lamp holder as a lamp is inserted thereinto;

FIG. 13 is a partially sectioned side elevation of a contact-spring used in a specific embodiment of the present lamp holder; and FIGS. 14 and 15 show a side and a front elevation, respectively, of a lever used to eject a lamp from the present lamp holder.

DETAILED DESCRIPTION

Figure 5:
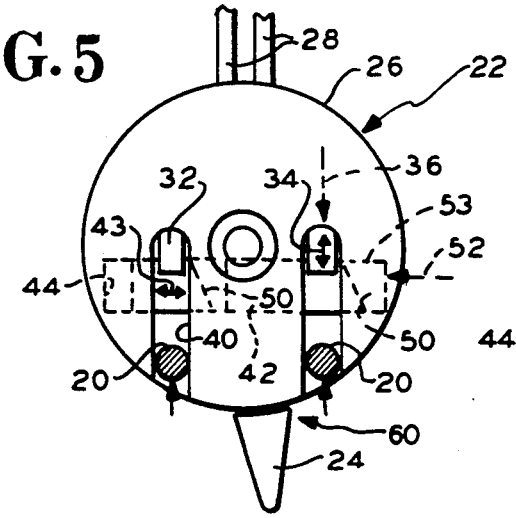
Figure 6:
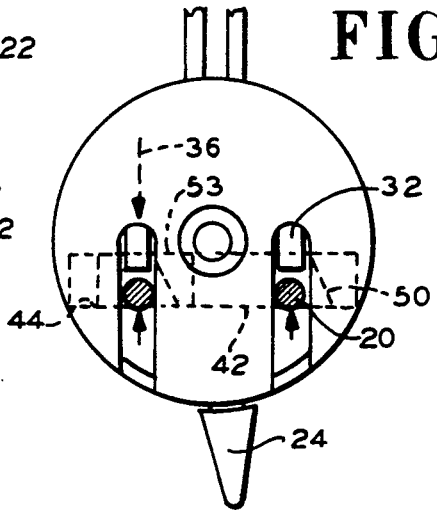
Figure 7:
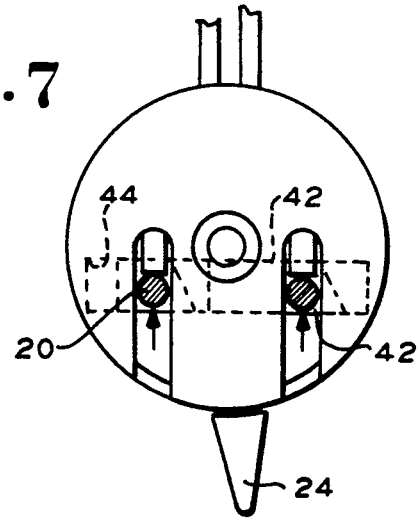

FIG. 1 depicts a light fixture 10 which includes a lamp 12 and opposed lamp holders 14 according to the present invention. The lamp 12 may be a standard, bipin fluorescent lamp having a glass envelope or tube 16 which contains appropriate electrically energizeable light-emitting facilities (e.g., gases, electrodes), which are not shown. The envelope 16 mounts end members 18 each of which may carry two pin electrodes 20. Application of electrical power to the pins 20 illuminates the lamp 12. As seen in FIG. 1, the lamp holders 14 of the present invention include a housing 22 and a finger-engageable lever 24. The lamp 12 is installed in the holders 14 simply by inserting the pins 20 into the holders 14 and pushing the lamp 12 upwardly. Thereafter, the lamp 12 is positively held in place for operation. Movement of the levers 24, ejects the lamp 12 from the holders 14.

Referring now to FIGS. 2–4, the housing 22 of each lamp holder 14 may comprise a generally right circular cylindrical or cup or chamber 26 closed by a cover 27 (FIG. 4), both being molded from a robust plastic. Wires or conductors 28 pass through the top of the cylinder 26 and enter the interior thereof for connection to. The contacts 32 are mounted within the cylinder 26 for movement along a defined path 34. This may be achieved in several ways. First, at diagramatically shown in FIG. 2, the contacts 32 may slide in a track which is congruent with the path 34 and which is integrally formed within the chamber 26 and/or the cover in any convenient fashion. As shown by the arrows 36, coil or leaf springs or other resilient members act between the chamber 26 (and/or the cover 27) and the contacts 32 to bias the contacts 32 downwardly as seen in FIG. 2. Second, and referring to FIG. 13, the contacts 32 may each comprise a bent conductive member 37, a portion of which comprises the contact 32 and another leaf spring portion of which comprises the spring 36. In this event, the contact 32 follows the path 34, due to the configuration and material of the member 37, as the leaf spring 36 flexes.

A forward wall 38 of the cylinder 26—a wall 38 which is adjacent the end member 18 in FIG. 1—has formed therein a pair of parallel blind slots 40. The slots 40 overlie the path 34 and receive and permit sliding movement therewithin of the pins 20. The slots 40 and the contacts 32 are also aligned and are positionally related so that in a first position of the contacts 32, under the action of the springs 36, the contacts 32 overlie the slots 40 and are abuttable by the pins 20 when the pins 20 are inserted into and moved along the slots 40 in a first direction (upward in FIG. 2) toward the contacts 32. Once abutment between the contacts 32 and the pin 20 occurs, further movement of the pins 20 in the first direction moves the contacts 32 in the first direction against the action of the springs 36 until the pins 20 abut the ends of the slots 40.

Figure 11:
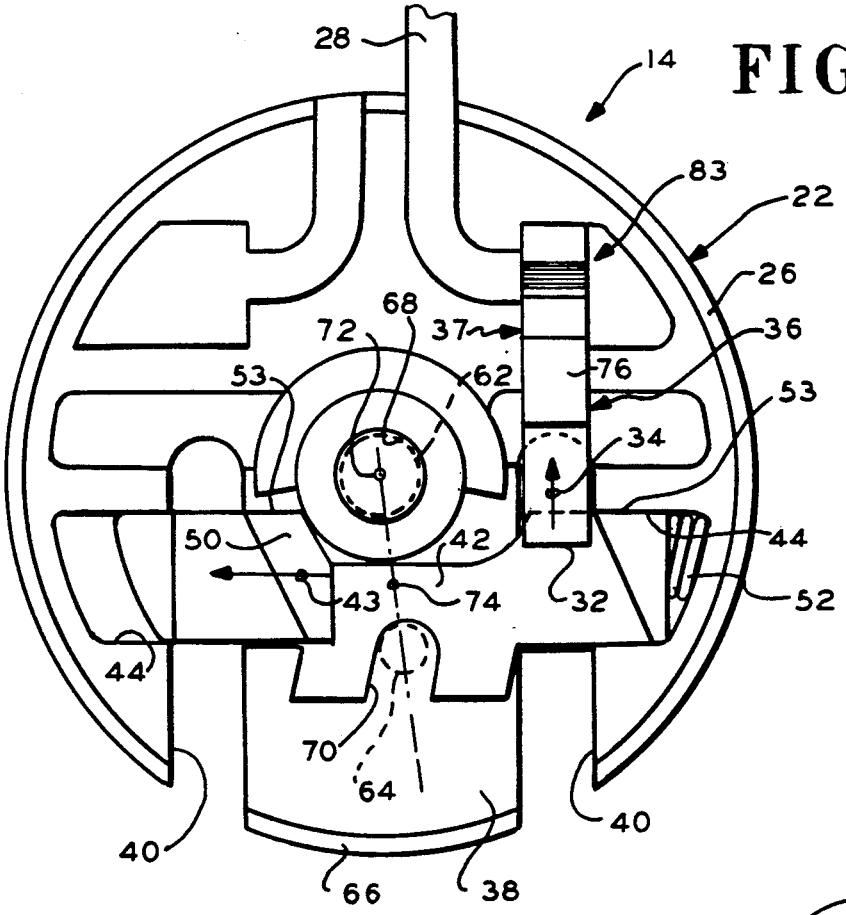
FIG. 11 is a rear elevation similar to FIG. 2 of a specific embodiment of the holder with a cover portion of a housing removed to show the interior thereof.
Figure 12:
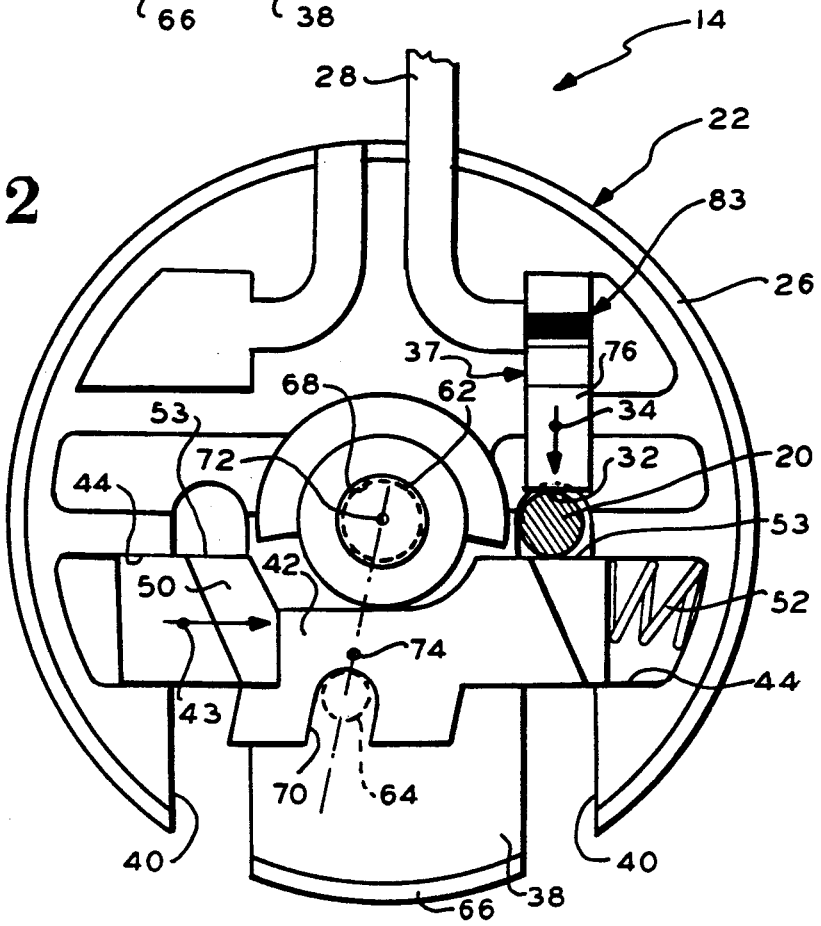
FIG. 12 is a rear elevation similar to FIG. 9 which shows the interior of the lamp holder of FIG. 11 at a differ time.

Also mounted within the chamber 26 is a slide 42. The slide is diagramatically depicted in FIGS. 5–10 and a specific embodiment thereof is shown in FIGS. 11 and 12. The slide 42 is movable in opposed directions along a path 43 which is transverse to the direction of the slots 40 and to the path 34 of movement of the contacts 32 and the pins 20 relative to the slots 40. A track 44 congruent with the path 43 may be integrally molded into the interior of the chamber 26 and/or the cover 27 to constrain the slide 42 to follow the path 43. The slide 42 includes a pair of projections or latches 50 which extend from the slide 42 toward the slots 40 (out of the plane of FIGS. 5–12). When the contacts 32 are in the location depicted in FIGS. 2 and 5–11 under the action of the springs 36, the contacts 32 lie in the path of leftward movement of the projections 50 and thereby prevent leftward movement of the slide 42. If the contacts 32 were moved upwardly by a sufficient amount, the slide 42 and its projections 50 would be free to move leftwardly.

The normal location of the slide 42 is as depicted in FIGS. 2, 5–7 and 11. A coil spring or other biasing member 52 (diagramatically represented by an arrow in FIGS. 2 and 5; and FIGS. 11 and 12) biases the slide 42 leftwardly (in FIGS. 2 and 5–11) toward a second location whereat the projections or latches 50 overlie the slots 40 (FIGS. 9 and 12).

Figure 8:
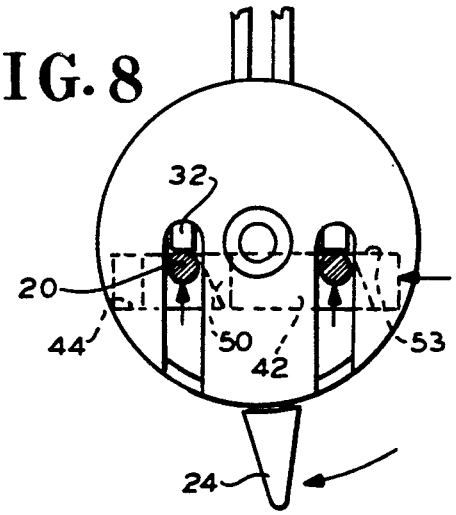
Figure 9:
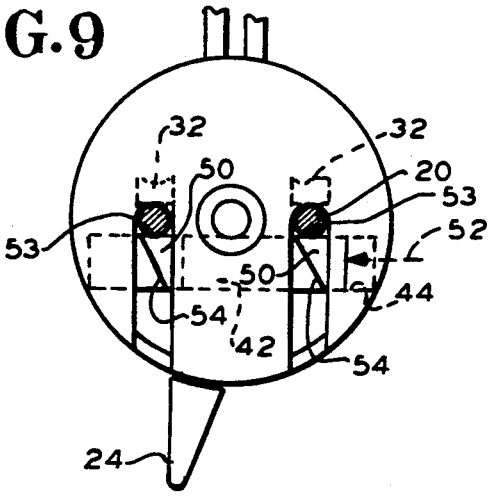
Figure 10:
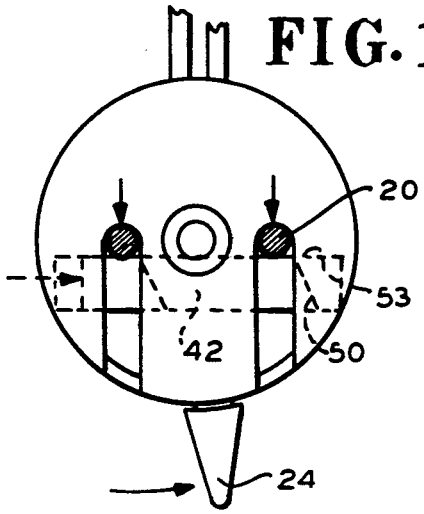

Referring to FIGS. 5–12, when the pins 20 are first inserted into the slots 40 (FIGS. 5 and 11), the springs 36 maintain the contacts 32 in their first positions which both overlie the slots 40 and block movement of the projections or latches 50. This blockage prevents the spring 52 from moving the slide 42 leftwardly. Movement of the pins 20 up along the slots 40 (FIG. 6) ultimately bring them into abutment with the contacts 32 (FIG. 7), and continuing movement moves the contacts 32 out of the path of the projections or latches 50 (FIG. 8). However, the pins 20 now lie in the path of movement of the projections or latches 50 (FIG. 8), continuing to block movement thereof. Yet further upward movement of the pins 20 and the contacts 32 against the action of the springs 36 finally removes both the contacts 32 and the pins 20 from the path of movement of the projections or latches 50, permitting the spring 52 to move the slide 42 and the projections or latches 50 leftwardly (FIGS. 9 and 12). Leftward movement of the projections or latches 50 moves them to a location whereat they overlie the slots 40 and block reverse or downward movement of the pins 20 and the contacts 32 by the springs 36 due to interference between a lateral surface 53 of the projections or latches 50 and the pins 20. (FIGS. 9 and 12). Thereafter, the springs 36 maintain sure electrical contact between the contacts 32 and the pins 20 by urging both against the projections or latches 50. As shown in FIG. 9, the distance between the ends of the slots 40 and the lateral surfaces 53 of the projections or latches 50 is only slightly greater than the diameter of the pins 20.

The projections or latches 50 may include cam surfaces 54 which ride against both the contacts 32 and the pins 20 as they move toward the ends of the slots 40 to reduce any binding (FIG. 8).

From the structure so far described, it should be clear that with the pins 20 held in place in the holder 14, rightward movement of the slide 42 against its spring 52 will move the projections latches 50 rightwardly to ultimately free the pins 20 and the contacts 32 for movement by the springs 36 to thereby eject the pins 20 from the slots 40 and from the holder 14. To that end, the lever end 24 is an integral part of a rotatable lever 60 which is mounted within the chamber 26. Specifically, the lever 60 includes a round projection 62 at its end opposite the end 24. A round pin 64 projects from the lever 60 between the ends 24 and 62. The lever 60 passes through a slot 66 (FIGS. 11 and 12) in the chamber 26 and the projection 62 is rotatably held in a circular bore 68 defined within the chamber 26 while the pin 64 is held in a notch 70 formed in the slide 42 as seen in FIGS. 11 and 12. The lever 60 is pivotable about a pivot center 72 so that its centerline 74 which passes through the pin 64 swings from side to side. When the slide 42 is held in its normal position (FIG. 5–8 and 11) the lever 60 and its end 24 and centerline 74 are located to one side of the vertical. When the slide 42 has moved to retain the pin 20 in the lamp holder 14 (FIGS. 9 and 12), the lever 60 slits end 24 and its centerline 74 are located to the other side of the vertical. The lever 60 is pivotally and slidably connected to the slide 42. Friction between the surfaces 53 of the projections or latches 50 and the pins 20 prevents the lever 60 from inadvertently rotating in a direction which will release the pins 20. When ejection of the pins 20 is desired, the lever end 24 in FIGS. 9 and 11 is moved to rotate the lever 60 and to move the slide 42 and the latches 50 (FIG. 10) against the action of the spring 52. As the lateral surfaces 53 of the projections 50 the pins 20, the springs 36 move the contacts 32 and the abutting pins 20 down to eject the pins 20. The contacts 32 once again block movement of the slide 42 by interfering with the projections 50.

Electrical connection between the wires 28 and the contacts 32 may be achieved in any convenient manner. In a specific embodiment and as seen in FIG. 13, where each contact 32 and spring 36 forms a part of the bent conductive member 37, such member may also include facilities for connecting the wire 28 thereto. Specifically the contact 32 and spring 36 are connected by a leg 76 to one arm 78 of a U-shaped portion 80. The end of the other arm 82 of the portion 80 is bent into an "S" 83 one opening of which mounts an end of a wire 28 by crimping, welding, soldering or the like. The member 37 may be held in place by the cover 27 which traps the leg 76 between itself and a projection 84 on the interior of the chamber 22 so that the contact 32 is properly associated with its slot 40. The solid line depiction of the contact and spring 32 and 36 in FIG. 13 corresponds with their locations in FIGS. 2, 5–7 and 11, while the broken line depiction corresponds to FIGS. 9 and 12.

The various non-metallic structural elements of the holder 14 may be made of durable molded plastic. As can be seen, the holder 14 comprises, other than the contacts 32 and the springs 36 and 52 only four parts, the chamber 26, the cover 27, the slide 42 and the lever 60. This simple arrangement of inexpensive parts has been found to be easy to use and to provide for positive self-locking.

The above sets forth certain preferred embodiments of the present invention. Other arrangements and embodiments falling within the scope of the appended claims will be apparent to those skilled in the art.

I claim:

1. A self-locking holder for a bipin lamp comprising:

a housing;

blind slots in the housing for receiving the pins for movement in a first direction along the slots and perpendicular to the pins;

contacts within the housing respectively associated with the slots;

first means for biasing the contacts to a first position relative to the slots whereat the contacts are abuttable by the pins, sufficient movement of the pins in the first direction along the slots effecting, first, abutment of the pins against the contacts, and then, movement of the contacts and the pins against the biasing means to a second position;

a movable slide within the housing normally held in a first location by the contacts in their first position;

second means for biasing the slide toward a second location;

latches on the slide, the latches being away from the slots in the first location of the slide, movement of the contacts and the pins to the second position permitting the second biasing means to move the slide to its second location whereat the latches block movement of the pins and the contacts by the first biasing means out of the second position in a second direction opposite to the first direction; and means for selectively moving the slide against the second biasing means and from the second location to the first location so that the first biasing means and the contacts move the pins out of the slots in the second direction and so that the contacts thereafter hold the slide in the first location.

2. A bipin lamp holder as in claim 1, wherein:

the slide is held in its normal first position by interference between the contacts in their first position and the latches when the slide is in its first location.

3. A bipin lamp holder as in claim 1, which further comprises:

camming surfaces on the latches engageable by the pins as the contacts move out of their first position and as movement of the slide to its second location continues to be blocked by engagement between the latches and the pins, the camming surfaces permitting the pine to bypass the latches and move with the contacts to the second position.

4. A bipin lamp holder in claim 1, wherein:

the slide moving means includes a lever mounted for rotation within the housing and having a manually engageable end external to the housing, and a connection between the lever and the slide within the housing that effects movement of the slide out of its second location and into its first location upon selective rotation of the lever due to manipulation of the manually engageable end.

5. A bipin lamp holder as in claim 1, wherein:

the major axes of the slots and the movement of the contacts and the pins are generally coincident, and the major axes of the pins and the direction of movement of the slide are mutually perpendicular and both are perpendicular to the major axes of the slots.

6. A bipin lamp holder as in claim 1, wherein:

the ends of the slots constitute the limits of travel of the pins along the slots in the first direction.

7. A lamp fixture which includes two opposed holders of the type set forth in claim 1 for holding a lamp having two sets of pins at opposed ends thereof.

8. A bipin lamp holder as in claim 1, wherein:

the first biasing means includes resilient members acting between the housing and the contacts, and the second biasing means includes a resilient member acting between the slide and the housing.

9. A bipin lamp holder as in claim 8, wherein:

each first biasing means includes a leaf spring, one end of which constitutes one of the contacts.

10. A self-locking holder for a lamp having a pin contact comprising:

a housing;

a blind slot in the housing for receiving the pin for movement in a first direction along the slot and perpendicular to the pin;

a contact within the housing;

first means for biasing the contact to a first position relative to the slot whereat the contact is abuttable by the pin, sufficient movement of the pin in the first direction along the slot effecting, first, abutment of the pin against the contact, and then, movement of the contact and the pin against the biasing means to a second position;

a movable slide within the housing normally held in a first location by the contact in its first position;

second means for biasing the slide toward a second location;

a latch on the slide, the latch being away from the slot in the first location of the slide, movement of the contact and the pin to the second position permitting the second biasing means to move the slide to its second location whereat the latch blocks movement of the pin and the contact by the first biasing means out of the second position in a second direction opposite to the first direction; and means for selectively moving the slide against the second biasing means and from the second location to the first location so that the first biasing means and the contact move the pin out of the slot in the second direction and so that the contact thereafter holds the slide in the first location.

11. A bipin lamp holder as in claim 10, wherein:

the slide is held in its normal first position by interference between the contact in its first position and the latch when the slide is in its first location.

12. A bipin lamp holder as in claim 11, wherein:

the first biasing means includes a resilient member acting between the housing and the contact, and the second biasing means includes a resilient member acting between the slide and the housing.

13. A bipin lamp holder as in claim 12, wherein:

the slide moving means includes a layer mounted for rotation within the housing and having a manually engageable end external to the housing, and a connection between the lever and the slide within the housing that effects movement of the slide out of its second location and into its first location upon selective rotation of the lever due to manipulation of the manually engageable end.

14. A bipin lamp holder as in claim 13, wherein:

the end of the slot constitutes the limit of travel of the pin along the slot in the first direction.

15. A lamp fixture which includes two opposed holders of the type set forth in claim 14 for holding a lamp having a pin at opposed ends thereof.

* * * * *